United States Patent [19]

Nakahira

[11] Patent Number: 4,566,615

[45] Date of Patent: Jan. 28, 1986

[54] APPARATUS FOR TURNING A CIRCULAR KNIT HOSE INSIDE OUT AND SECTIONING SAME INTO UNIT HOSES

[76] Inventor: Tomotake Nakahira, 140-5, Tsukiyama, Yamatotakadashi, Naraken, Japan

[21] Appl. No.: 571,485

[22] Filed: Jan. 17, 1984

[51] Int. Cl.[4] ..... A41H 43/00

[52] U.S. Cl. ..... 223/43; 112/121.15; 112/262.2

[58] Field of Search ..... 223/43; 112/121.15, 112/262.2

[56] References Cited

U.S. PATENT DOCUMENTS

| | | | |
|---|---|---|---|
| 3,577,942 | 5/1971 | Hulin | 223/43 X |
| 4,132,183 | 1/1979 | Kienel | 112/121.15 X |
| 4,460,111 | 7/1984 | Nakahira | 223/43 |

*Primary Examiner*—Louis K. Rimrodt
*Attorney, Agent, or Firm*—Barnes & Thornburg

[57] ABSTRACT

An apparatus for turning a circular knit hose inside out, sectioning the knit hose into unit hoses, and linking each toe portion thereof with stitches, characterized in that the apparatus comprising an air suction pipe for pulling a long knit hose by air suction therethrough, a cutter unit mounted on a movable carrier, the cutter unit having means whereby the knit hose is stretched so as to ensure an easy cutting, an apron conveyor having slats transversely provided, each of the slats including a hollow cylinder for allowing a circular knit hose to be supported thereon, and a clamp unit located at the opposite side to the cylinder, the clamp unit being capable of tilting toward the cylinder, a linking device located at a position where the clamp unit is tilted, means for releasing the knit hose from the clamp unit, and a suction duct for pulling the unit knit hose by suction, the suction duct being communicatable with the rear end of the cylinder which comes to the turning point of the conveyor.

1 Claim, 16 Drawing Figures

APPARATUS FOR TURNING A CIRCULAR KNIT HOSE INSIDE OUT AND SECTIONING SAME INTO UNIT HOSES

BACKGROUND OF THE INVENTION

The present invention relates to apparatus for turning circular knit hose inside out, sectioning it into a required number of unit hoses and closing each toe thereof with stitches on a continuous line.

In the production of hosiery, such as stockings and socks, a commonly-called "rib knitter" or a double cylinder knitting machine is employed to knit a long continuous circular hose. In this process it is necessary to section a long continuous hose band into unit hoses. To this end waste portions must be interposed between adjacent unit hoses. The stitches around the sectioned part are picked up by the operator's fingers. This is an extremely labor- and time-consuming operation, which of course reflects in the price of the product.

In addition, to effect the subsequent linking operation on each toe, it is previously required to turn each hose inside out. After the linking operation is finished, the normal side is again turned outside so as to enable the unit hose to be vapor set. This is also very time-consuming.

OBJECTS AND SUMMARY OF THE INVENTION

The present invention aims at solving the problems mentioned above, and to provide an improve apparatus for turning a circular knit hose inside out, sectioning it into a required number of unit hoses, closing each toe thereof, and turning the normal side out in an automatic manner.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention, there is provided apparatus for turning a circular knit hose inside out, sectioning the knit hose into unit hoses, and linking each toe portion thereof with stitches, the apparatus comprising a suction pipe for pulling a knit hose by suction therethrough, a cutter unit mounted on a movable carrier, the cutter unit having means whereby the knit hose is stretched so as to ensure an easy cutting, an apron conveyor having slats transversely provided, each of the slats including a hollow cylinder for allowing a circular knit hose to be supported thereon, and a clamp unit located at the opposite side to the cylinder, the clamp unit being capable of tilting toward the cylinder, a linking device located at a position where the clamp unit is tilted, means for releasing the knit hose from the clamp unit, and a suction duct for pulling the unit knit hose by suction, the suction duct being communicatable with the rear end of the cylinder which comes to the turning point of the conveyor.

DETAILED DESCRIPTION OF THE INVENTION

Figure 1:
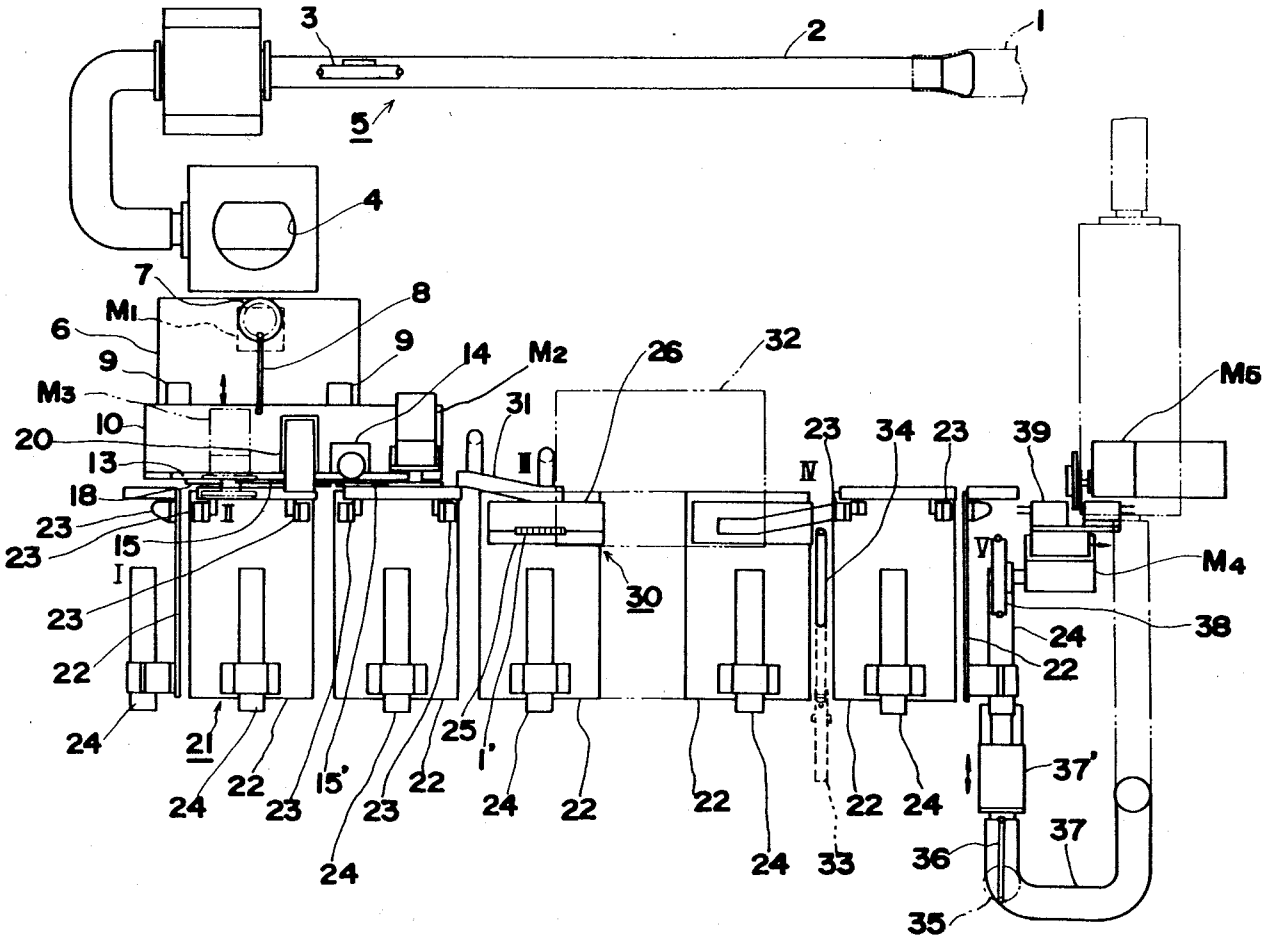
FIG. 1 is a plan view showing an apparatus embodying the present invention.

Referring to FIG. 1, a long continuous knit hose band 1 is fed from a double cylinder knitting machine (not shown) to an air suction pipe 2. The forward end of the knit hose 1 is placed around the 'tail end' of the pipe 2 by an operator as shown in FIG. 1. The reference numeral 3 designates a pair of contact rollers, which are capable of rolling on the air suction pipe 2 while keeping contact with the surface thereof, whereby the knit hose 1 is caused to slide on the surface of the air suction pipe 2 towards the 'top end' thereof until the forward end of the knit hose reaches the depth of the air suction pipe 2. At this stage the terminating end of the knit hose 1 projects slightly beyond the 'tail end' of the air suction pipe 2. When the air in the pipe 2 is sucked, the knit hose 1 is sucked into the air suction pipe 2. The air suction device is a known type, and a description thereof is omitted. The knit hose 1 which is turned inside out is taken out at an outlet 4. The process mentioned above is hereinafter referred to as the knit hose turning section 5.

Figure 2:
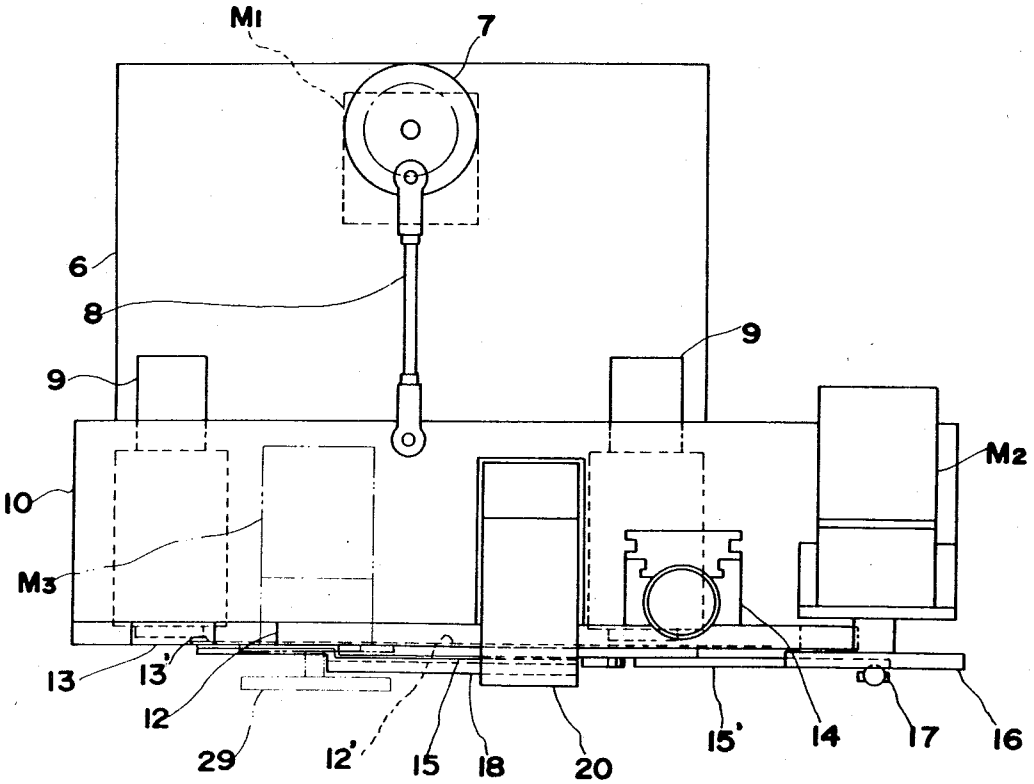
FIG. 2 is a plan view on an enlarged scale of the section indicated II in FIG. 1, at which the knit hose is stretched for cutting.

Referring to FIGS. 1 and 2, there is provided a bed 6 on which a crank disc 7 coupled to a driving shaft of an electric motor $M_1$ is mounted. The crank disc 7 has a rod 8 suspended downwards. The downward end of the crank rod 8 is fastened to a carrier 10 capable of vertically moving on a pair of rails 9 provided on the bed 6.

Figure 3:
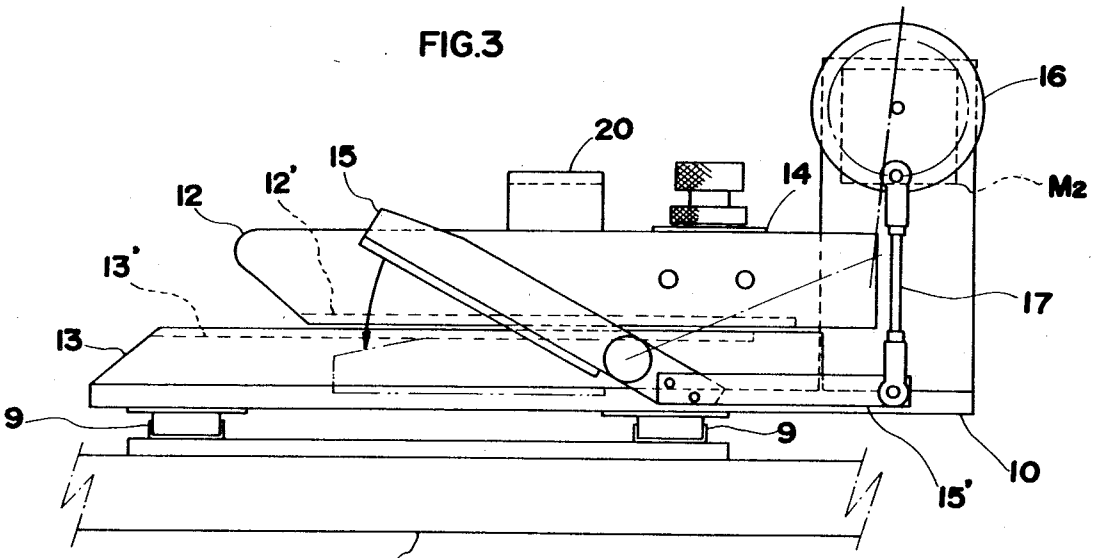
FIG. 3 is a front view on an enlarged scale of a cutter unit.
Figure 5:
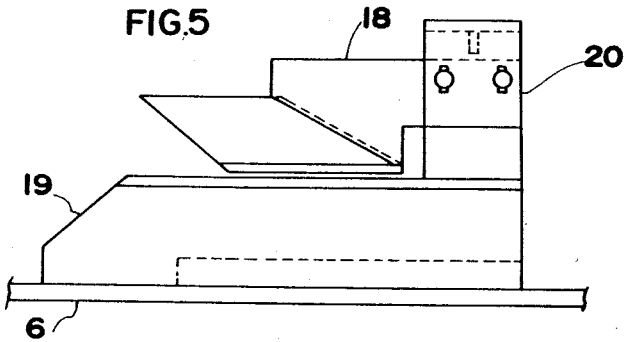
FIG. 5 is a front view on an enlarged scale of a guide unit.
Figure 6:
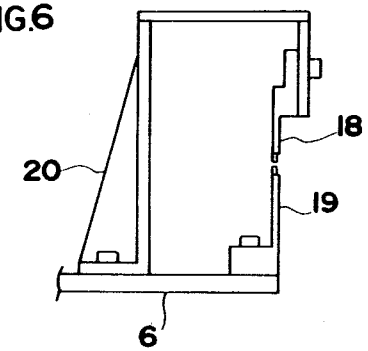
FIG. 6 is a left side view of the guide unit.
Figure 4:
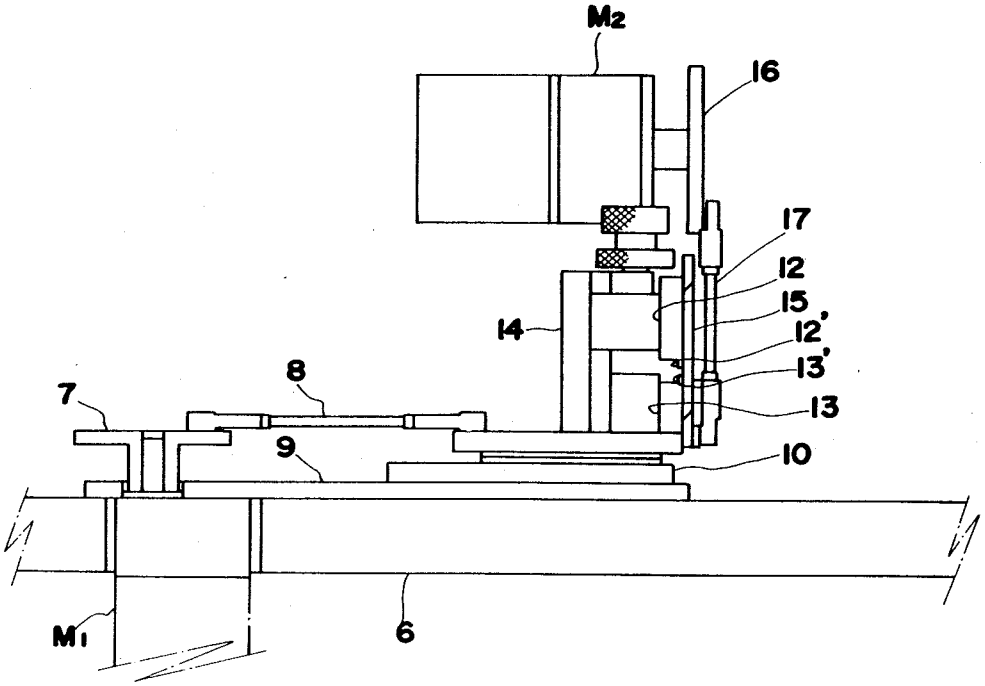
FIG. 4 is a left side view, partly omitted, of the cutter unit.

The knit hose band 1 is previously provided with a toe portion 1' and a welt portion 1'' between which the knit hose is additionally provided with a separating section 11. The separating section 11 is thin sufficiently to produce steps against the toe portion and the welt portions. The steps are intended to be engaged by an upper engager 12 having an upper cutter 12', and a lower engager 13 having a lower cutter 13'. As shown in FIGS. 2 and 3, the upper engager 12 and the lower engager 13 are mounted on the carrier 10, wherein the upper engager 12 is supported on a bracket 14 such that the height of the upper engager 12 is adjustable with respect to the knit hose 1, whereas the lower engager 13 is fixed to the carrier 10. In FIG. 3 the reference numeral 15 designates a cutting blade pivotally supported on the carrier 10. The cutting blade 15 is connected to a crank rod 17 of a crank disc 16 driven by an electric motor $M_2$ by means of a connecting rod 15'.

Figure 8:
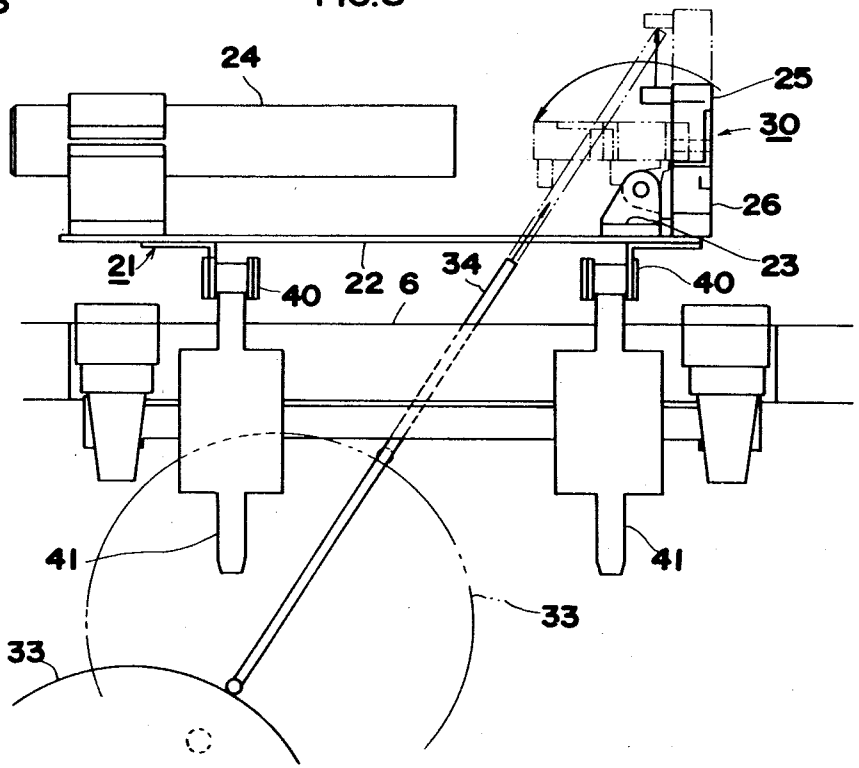
FIG. 8 is a right side view of the section shown in FIG. 7.
Figure 7:
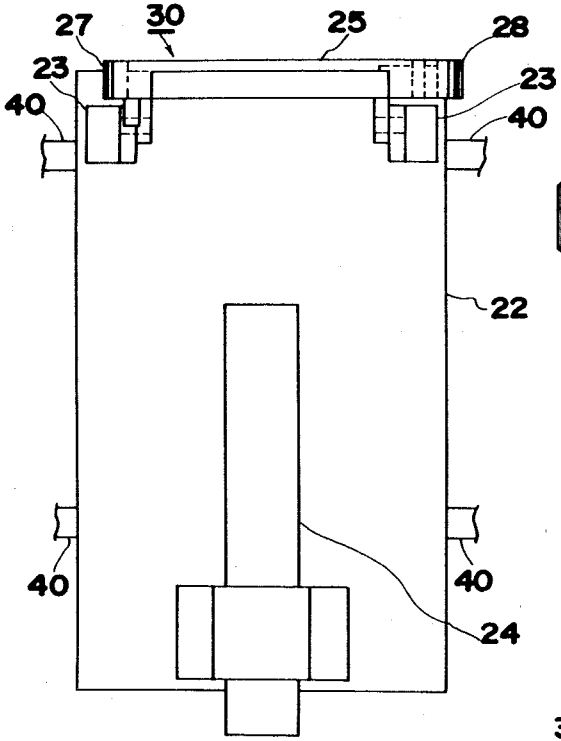
FIG. 7 is a plan view showing one section of an apron conveyor in which a slat is provided to support a hollow cylinder and a clamp unit.
Figures 9, 10, 11, 12, 13, 14, 15, 16:
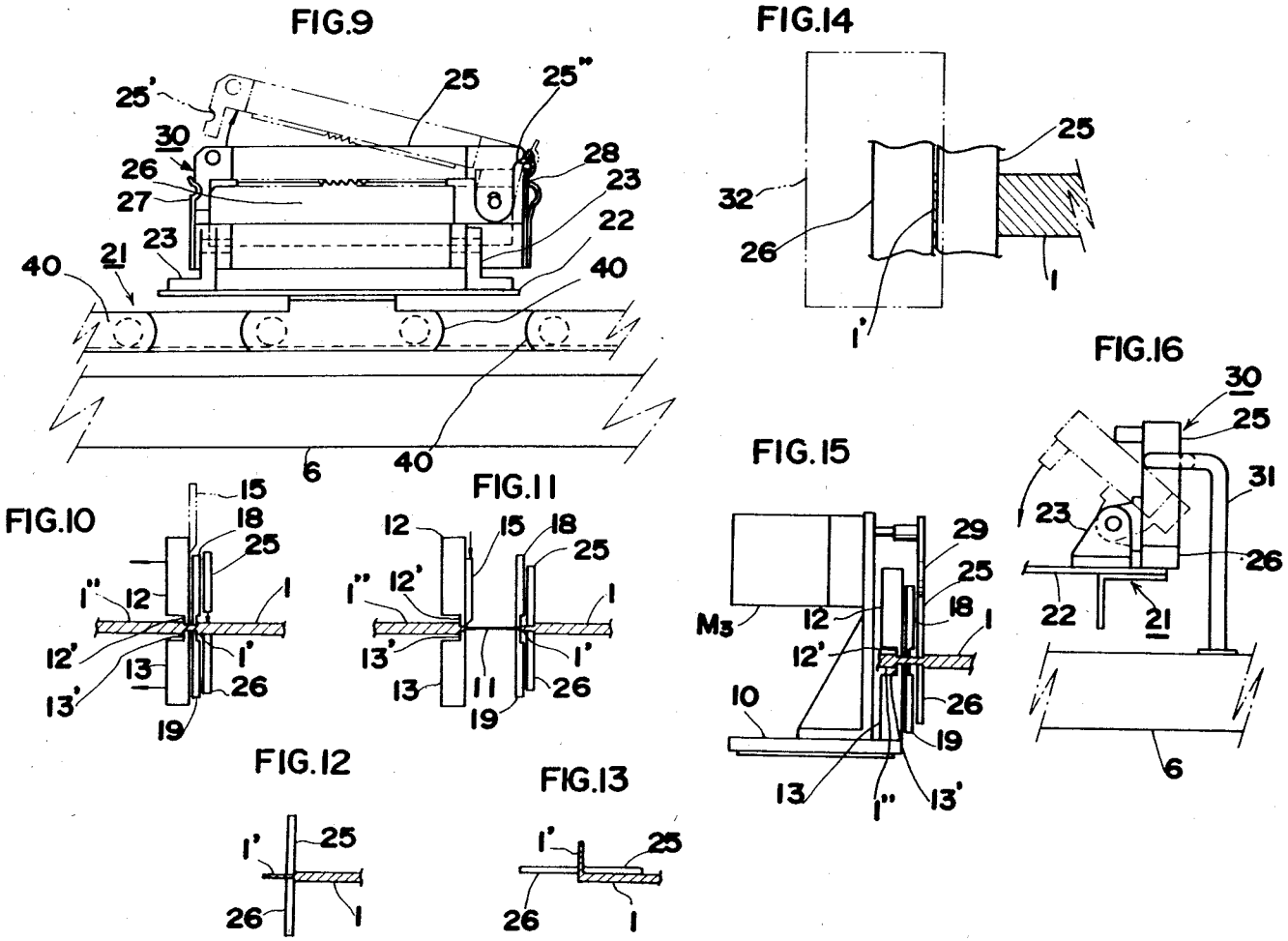
FIG. 9 is a front view, partly omitted, of the section shown in FIG. 7.
FIG. 10 is a schematic view showing the relationship between the guide unit and the clamp unit.
FIG. 11 is a schematic view showing the state at which the knit hose is stretched by engagers.
FIG. 12 is a schematic view showing the clamp unit holding a sectioned unit hose.
FIG. 13 is a schematic view showing the state at which the clamp unit is tilted at 90° thereby to cause the toe portion to stand upright for stitching.
FIG. 14 is a plan view showing the state of FIG. 13.
FIG. 15 is a schematic view showing the operation of the clamp unit.
FIG. 16 is a schematic view showing the relationship of the clamp unit and a pushing rod.

There is provided an upper guide 18 opposedly to the side of the upper engager 12, the guide 18 being supported on a bracket 20 upright on the bed 6 such that the height thereof is adjustable with respect to the knit hose 1. Likewise, there is provided a lower guide 19 slightly spced from the upper guide 18, the lower guide 19 being fixed to the bed 6. The positional relationship among the engagers 12 and 13, the guide members 18 and 19, and the knit hose 1 is best illustrated in FIG. 11. As shown in FIG. 10, the separating section 11 of the knit hose 1 is placed between the upper and the lower cutters 12' and 13', and between the upper and the lower guides 18 and 19. At this stage both engagers 12 and 13 are moved by energizing the motor $M_1$ in the direction indicated by the arrow in FIG. 10. Thus the separating section 11 is stretched as shown in FIG. 11, and cut at a point adjacent to the welt portion 1'' by means of the cutting blade 15. The reference numeral 21 designates an apron conveyor, which consists of a series of slats 22. As best shown in FIG. 8, each slat 22 is provided with a pair of brackets 23 at the inner side thereof, the brackets pivotally supporting a first plate member 26 to which a second plate member 25 is pivotally coupled. The two plate members 25, 26 are capable of pivotal movement in the direction indicated by the arrow in FIG. 8, so that they take a position indicated by dotted lines therein. FIG. 8 is a side view whereas FIG. 9 is a front view in which, unlike FIG. 8 the raised position is shown in dotted lines. The second plate member 25 is provided with a recess 25' at its top end as shown in FIG. 9, which recess 25' is engaged by a metal piece 27 fixed to an end face of the first plate member 26 so as to secure the union of the two plate members 25 and 26. The second plate member 25 is additionally provided with a projecting part 25'' at the opposite end, which is adapted for engagement with a spring member 28 fixed to the opposite end face of the first plate member 25. By engagement with the spring member 28 the second plate member 25 undergoes an upward urge. The contacting faces of the two plate members 25, 26 are formed in a saw-tooth form so as to enable both plates, when met, to function as a clamp suitable for holding a soft material, such as knit hose. The unit of the two plate members will be hereinafter referred to as the clamp unit 30.

In addition to the clamp unit 30, each slat 22 is provided with a short cylinder 24 at the opposite side to the brackets 23, that is, at the outer side of the apron conveyor 21, the short cylinder being held in parallel with the top surface of the slat 22 but spaced therefrom as best shown in FIG. 8. The short cylinder 24 is used to support a unit knit hose 1 which is placed around it. The short cylinder 24 is supported by a bracket (not numbered) or any other known means.

At the position indicated by the II in FIG. 1 an electric motor $M_3$ is supported on a stand (not numbered) on the carrier 10 as shown in FIG. 15, and a cam plate 29 is coupled to the shaft of the motor $M_3$. The cam plate 29 comes into contact with the second plate member 25 during rotation, thereby enabling the second palte member 25 to come into engagement with the first plate member 26. In this way the two plate members 25 and 26 are met between which the toe portion 1' is clamped with the indented faces. The knit hose 1 is fed in a continuous band to the position II at which it is sectioned into unit hoses, each of which is clamped by the clamp unit 30 and transported to a position III (FIG. 1). At the position III a pushing rod 31 is provided on the bed 6, at a position adjacent to the path along which the clamp units 30 pass. The pushing rod 31 is used to push the clamp unit 30 toward the short cylinder 24. The clamp unit 30 is inwardly tilted as shown in FIG. 16. When the clamp unit 30 is half tilted, the gravitation acts thereon to allow same to make flat. Thus the toe portion 1' is upwardly directed at which posture the toe portion is linked with stitches.

The reference numeral 32 designates a linking device whereby the toe portion 1' is stitched, the stiching device is located above the apron conveyor 21. The linking device 32 includes a crank disc 33 located at the position 1V (FIG. 1), a pushing rod 34 reciprocally moved in association with the rotation of the crank disc 33 while keeping contact with the periphery of the crank disc 33, wherein the pushing rod 34 is passed through the bed 6 in a diagonally upward posture as shown in FIG. 8. The pushing rod 34 causes the clamp unit 30 to stand uprightly when the clamp unit 30 reaches the position 1V with the toe portion 1' having its open ends stitched. The pushing rod 34 further advances, and lowers the second plate member 25 so as to disengage same from the first plate member 26. In this way the knit hose 1 is released from the clamp unit 30. At this stage the knit hose 1 is supported on the short cylinder 24, and reaches the position V.

At the position V there is provided a suction duct 37 whereby the knit hose 1 is again turned inside out such that its normal side comes outside. The reference numeral 37' designates a catcher reciprocally moved by means a crank rod 36 pivoted on a crank disc 35, the catcher 37' being connected to the suction duct 37. The catcher 37' is placed into engagement with the rear end of each short cylinder 24 as shown in FIG. 1.

At the position V where each slat 22 changes its posture from horizontal to vertical in accordance with the turning of the conveyor 21, there is provided a rotor 38 driven by a motor $M_4$, the rotor being adapted to cause the knit hose supported around the short cylinder 24 to advance toward the opening of the cylinder by friction. At this stage the short cylinder 24 is in communication with the suction duct 37 via the catcher 37'. The knit hose 1 half hung at the inner opening of the cylinder 24 is ready to be sucked into the suction duct 37 under pressure. The reference numeral 39 designates a bracket on which the motor $M_4$ is mounted. The bracket 39 is movable by a motor $M_5$ such that the rotor 38 is placed into contact with the knit hose on the short cylinder 24 and out of contact therefrom. In FIGS. 8 and 9 the reference numeral 40 designates carriers linked to each other so as to support the slats 22. The reference numeral 41 designates cams located in opposite sides of the conveyor 21, whereby the toe portion 1' of the knit hose reaching beneath the linking device 32 is raised upwards so as to facilitate the linking operation.

In operation, the forward end of a long continuous knit hose band 1 is placed around the 'tail end' of the suction pipe 2 by hand. The contact rollers 3 are started to rotate and advance to the 'tail end' of the suction pipe 2, then returns to the depth of the suction pipe 2 while pulling the knit hose band by friction. At this stage the terminating end of the knit hose band 1 slightly projects beyond the 'tail end' of the suction pipe 2. Then the air in the pipe 2 is sucked, thereby causing the knit hose band to be sucked from its terminating end into the suction pipe 2. In this way the knit hose is turned inside out. The contact rollers 3 are reversely rotated and advanced so as to facilitate the long knit hose band 1 being sucked into the pipe 2. The turned knit hose band 1 is taked out of the outlet 4 by the operator. At the position I (FIG. 1) the knit hose band 1 is placed around each short cylinder 24 one by one, and at the position II the separating section 11 of the knit hose 1 is placed between the upper and the lower cutters 12', 13', and between the upper and the lower guides 18, 19. The motor $M_1$ is switched on, and the carrier 10 is moved, thereby causing the engagers 12, 13 to separate from the guides 18, 19. Thus the separating section 11 is stretched as shown in FIG. 11. At this moment the motor $M_3$ is switched on, and the cam plate 29 is rotated, thereby pressing the second plate member 25 against the first plate member 26 so as to hold the toe portion 1' of the knit hose therebetween. Then the motor $M_2$ is switched on, and cutting blade 15 cuts the knit hose in its separating section 11. The clamp unit 30 continues to hold the knit hose 1, and at the position IV the clamp unit 30 comes into engagement with the pushing rod 31, whereby the clamp unit 30 is tilted at 90° thereby to cause the toe portion 1' to direct upwards. At this moment the slat 22 is raised toward the linking device 32 by the action of the cams 41. The linking operation is started on the toe portion 1'. When the clamp unit 30 comes into engagement with the pushing rod 34 at the position IV, the clamp unit 30 is caused to stand upright, and the pushing rod 34 raises the second plate member 25 thereby to release the toe portion 1' from the clamp unit 30.

When the knit hose 1 held on the short cylinder 24 reaches the position V, the motor $M_5$ is switched on, and the rotor 38 is moved above the short cylinder 24. Simultaneously, the catcher 37' is placed into engagement with the rear end of the short cylinder 24 so as to secure the internal communication therebetween. When the suction duct 37 is connected to the short cylinder 24 through the catcher 37', the motor $M_4$ is switched on, and the rotor 38 is rotated in the direction in which the toe portion 1' is displaced toward the forward opening of the short cylinder by friction. The suction is started through the suction duct 37, whereby the knit hose 1 is turned inside out again, which means that its normal side comes outside.

What is claimed is:

1. An apparatus for turning a circular knit hose inside out, sectioning the knit hose into unit hoses, and linking each toe portion thereof with stitches, the apparatus comprising:

an air suction pipe for pulling a long knit hose by air suction therethrough, a cutter unit mounted on a movable carrier, the cutter unit having means whereby the knit hose is stretched so as to ensure an easy cutting, an apron conveyor having slats transversely provided, each of the slats including a hollow cylinder for allowing a circular knit hose to be supported thereon, and a clamp unit located at the opposite side to the cylinder, the clamp unit being capable of tilting toward the cylinder, a linking device located at a position where the clamp unit is tilted, means for releasing the knit hose from the clamp unit, and a suction duct for pulling the unit knit hose by suction, the suction duct being communicatable with the rear end of the cylinder which comes to the turning point of the conveyor.

* * * * *